United States Patent [19]

Yasuhara et al.

[11] 4,311,535

[45] Jan. 19, 1982

[54] COMPOSITION FOR FORMING ZINC PHOSPHATE COATING OVER METAL SURFACE

[76] Inventors: Kiyotada Yasuhara; Masashi Takahashi, both c/o Nippon Paint K.K. 1-15 Minami Shinagawa 4-Chome,, Shinagawa-ku, Tokyo; Ryoichi Murakami; Takashi Senzaki, both of c/o Nippon Paint K.K. 19-17, Ikeda Nakamachi, Neyagawa-shi, Osaka, all of Japan

[21] Appl. No.: 145,586

[22] Filed: May 1, 1980

[30] Foreign Application Priority Data

May 11, 1979 [JP] Japan ..... 54-58341

[51] Int. Cl.[3] ..... C23F 7/08

[52] U.S. Cl. ..... 148/6.15 Z; 148/31.5; 204/181 R; 204/181 C

[58] Field of Search ..... 148/6.15 Z, 31.5; 204/181 R, 181 C

[56] References Cited

U.S. PATENT DOCUMENTS

| | | | |
|---|---|---|---|
| 3,333,988 | 8/1967 | Douty et al. | 148/6.15 Z |
| 3,676,224 | 7/1972 | Snee | 148/6.15 Z |
| 3,850,700 | 11/1974 | Heller | 148/6.15 Z |
| 4,265,677 | 5/1981 | Muller et al. | 148/6.15 Z |

FOREIGN PATENT DOCUMENTS

| | | | |
|---|---|---|---|
| 110060 | 2/1974 | German Democratic Rep. | 148/6.15 Z |

*Primary Examiner*—Ralph S. Kendall

*Attorney, Agent, or Firm*—Alexis Barron

[57] ABSTRACT

An acidic aqueous zinc-containing coating solution containing about 0.08 to about 0.2 weight percent of zinc, about 0.8 to about 3 weight percent of phosphate, about 0.05 to about 0.35 weight percent of chlorate, about 0.001 to about 0.1 weight percent of nitrite, and a complex fluoride ion having the following concentration:

$$0.4 \geqq y \geqq 0.63x - 0.042$$

wherein x is the concentration of the zinc in weight percent and y is the concentration of the complex fluoride ion in weight percent. The coating solution is useful for forming on metal surfaces zinc phosphate coatings that exhibit excellent alkali resistance, good adhesion to a paint film, and good corrosion resistance after painting when used as an undercoat for the cationic electrodeposition of a paint film.

24 Claims, No Drawings

COMPOSITION FOR FORMING ZINC PHOSPHATE COATING OVER METAL SURFACE

BACKGROUND OF THE INVENTION

The present invention relates to acidic, aqueous compositions for forming zinc phosphate coatings on metal surfaces, and more specifically to a composition for forming an improved zinc phosphate coating that provides excellent corrosion resistance and paint adhesion on a metal substrate. The improved zinc phosphate coating is particularly suitable as an undercoat for cationic electrodeposition. Heretofore, zinc phosphate coatings have been applied to metal surfaces as an undercoat in order to maximize the properties of coats formed by electrodeposition, generally anionic electrodeposition. In recent years, the growing demand for higher corrosion resistance of the coats has brought about an innovation in the electrodeposition process. Since about 1977, cationic electrodeposition paints having improved corrosion resistance have been developed and put into practice.

In order to make best use of the high corrosion resistance of cationic electrodeposition paints, it is necessary to form a zinc phosphate coating over the object to be painted. Our research into an undercoat that is suitable for cationic electrodeposition has uncovered the fact that the zinc phosphate coats that have been used as an undercoat for anionic electrodeposition exhibit suprisingly poor adhesion to the cationic electrodeposition paints, frequently resulting in poor corrosion resistance due to the breakdown of adhesion.

The causes of this adhesion breakdown are unknown so far, but we theorize, in view of the reaction mechanism for electrodeposition, that the electrodeposition bath in the vicinity of the object being treated becomes considerably acidic during the flow of electric current in anionic electrodeposition, while it becomes alkaline to a considerable degree in cationic electrodeposition so that the undercoats for cationic electrodeposition must exhibit good alkali resistance. The conventional zinc phosphate coatings, however, do not exhibit such alkali resistance. Another cause of the adhesion breakdown may be that, when corrosion takes place under a coating, oxygen is reduced to form an alkali. Thus, when the coating has a low alkali resistance, the coating surface is dissolved, thereby lowering the adhesion to the cationic electrodeposition paint (which has a large internal cohesive power). This may cause an adhesion breakdown, resulting in poor corrosion resistance.

Our study of undercoats capable of imparting alkali resistance to zinc phosphate coatings has led to the present invention, a composition containing a complex fluoride ion.

Until now, many kinds of coating solutions containing a complex fluoride ion have been disclosed, such as, for example, those disclosed in Japanese Patent Publication Nos. 4324/1965; 7129/1967; 12130/1967; and 14223/1975, and Japanese Patent Disclosure Nos. 28337/1973 and 140237/1978.

In Japanese Patent Publication Nos. 4324/1965 and 12130/1967 the object to be coated is a plate of zinc or zinc plated steel, and applied paints are thermosetting solvent type, not cationic electrodeposition. Phosphate coats formed over iron or steel surfaces according to such disclosures, when used as an undercoat for cationic electrodeposition, have poor adhesion to paint films and poor corrosion resistance.

In Japanese Patent Publication Nos. 7129/1967 and 14223/1975, the same coating solution can be used to process both iron and zinc materials, including iron and steel. Applied paints, however, are thermosetting solvent type, not cationic electrodeposition. Phosphate coats formed according to such disclosures, when used as an undercoat for cationic electrodeposition, provide poor paint film adhesion and poor corrosion resistance, and thus are commercially unacceptable.

In Japanese Patent Disclosure Nos. 28337/1973 and 140237/1978, the same treating liquid can be used to process iron, zinc and aluminum materials, including iron and steel. However, the applied paints of Japanese Patent Disclosure No. 28337/1973 are thermosetting solvent type, not cationic electrodeposition. Phosphate coats formed according to that disclosure, when used as an undercoat for cationic electrodeposition, provide poor paint film adhesion and poor corrosion resistance, and thus are commercially unacceptable.

Japanese Patent Disclosure No. 140237/1978 is concerned with undercoats for anionic electrodeposition. Phosphate coats formed according to that disclosure have poor alkali resistance, and, when used as an undercoat for cationic electrodeposition, the coatings of the disclosure provide poor paint film adhesion and poor corrosion resistance.

Furthermore, Japanese Patent Publication Nos. 12130/1967 and 14223/1975 and Japanese Patent Disclosure No. 140237/1978 require a metal selected from the group consisting of ferric iron, magnesium, and manganese and mixtures thereof as well as the zinc which is a major ingredient of the coating composition. Japanese Patent Publication No. 4324/1965 requires glycerophosphoric acid as an essential ingredient.

Thus, all of the prior art coating compositions containing a complex fluoride ion are substantially different from the compositions of the present invention.

OBJECTS OF THE INVENTION

It is an object of the invention to provide an acidic aqueous composition for forming over a metal surface a zinc phosphate coating as an undercoat for cationic electrodeposition of a paint film, which coating exhibits excellent alkali resistance, good paint film adhesion, and good corrosion resistance after painting.

It is further object of the invention to provide a method of applying such coatings to a metal surface to produce coatings having the aforementioned properties.

SUMMARY OF THE INVENTION

The present invention includes the provision of an acidic aqueous zinc phosphate coating composition containing about 0.08 to about 0.2% by weight of zinc ion, about 0.8 to about 3% by weight of phosphate ion, about 0.05 to about 0.35% by weight of chlorate ion, about 0.001 to about 0.1% by weight of nitrite ion and a complex fluoride ion having the following concentration:

$$0.4 \geqq y \geqq 0.63x - 0.042$$

where x is the concentration of the zinc ion in weight percent and y is the concentration of the flouride complex ion in weight percent. The composition is capable of being used to form zinc phosphate coatings having excellent alkali resistance, good paint film adhesion, and good corrosion resistance after painting.

The coating solution is applied to the metal object to be coated by any of the known methods of application. Preferably, the coating solution is applied at a temperature from about 35° to about 65° for a time longer than about 30 seconds.

In addition to the aforementioned essential ions, the coating composition may preferably contain, as nonessential ions, nickel and/or nitrate ions.

DETAILED DESCRIPTION OF THE INVENTION

The zinc ion in the coating composition of the invention may be supplied in the form of a soluble zinc containing compound, for example, zinc phosphate, zinc nitrate, zinc carbonate, zinc hydroxide, zinc oxide, or in the form of zinc metal (including ingots). The concentration of zinc ion in the composition may range from about 0.08 to about 0.2% by weight. If the concentration is below about 0.08% by weight, the resulting coatings become uneven, making the subsequently electrodeposited paint films uneven. This, in turn, necessitates additional grinding, thus lowering the efficiency of operation and the paint corrosion resistance. If the concentration is above about 0.2% by weight, the coating weight becomes too great to permit improvement of the resulting zinc phosphate coat by addition of the complex fluoride ion, thus yielding a coating having poor adhesion to a paint film and poor corrosion resistance after painting.

The concentration of the phosphate ion in the composition of the invention may range from about 0.8 to about 3% by weight, preferably from about 0.8 to about 2% by weight. If the concentration is below about 0.8% by weight, the resulting coatings are uneven films with spaces and/or yellow rust. If the concentration is above about 3% by weight, formation of a sufficient zinc phosphate coating fails to take place, producing a blue iron phosphate coating having a lower corrosion resistance after painting. The phosphate ion may be supplied in the form of a soluble salt and/or an acid, for example, phosphoric acid, sodium phosphate, and other alkali metal phosphates, zinc phosphate and nickel phosphate.

The chlorate ion in the composition of the invention may be supplied in the form of a soluble salt and/or an acid, for example, chloric acid, sodium chlorate, potassium chlorate, and other alkali metal chlorates. The suitable concentration of chlorate ion in the composition may range from about 0.05 to about 0.35% by weight. If the concentration is below about 0.05% by weight, formation of yellow rust takes place. If the concentration is above about 0.35% by weight, formation of a sufficient zinc phosphate coating fails to take place, producing a coating having poor corrosion resistance after painting.

The nitrite ion in the composition of the invention may be supplied in the form of a soluble salt and/or an acid, for example, nitrous acid, sodium nitrite, potassium nitrite, and other alkali metal nitrites. The concentration of nitrite ion in the composition may range from about 0.001 to about 0.1% by weight. If the concentration is below about 0.001% by weight, the nitrite ion fails to act as an accelerator, and formation of yellow rust takes place. If the concentration is above about 0.10% by weight, the steel surfaces become too inert to form coatings.

The preferred complex fluoride ions in the composition of the invention are fluoborate ($BF_4^-$) and/or fluosilicate ($SiF_6^{2-}$). Other complex fluoride ions such as fluozirconic ion and fluotitanic ion may be used but have such poor solublility in the zinc phosphate coating solution that the object of the invention is achieved to a lesser extent. Free fluoride, for example, NaF, KF and HF, fails to produce the effect of the invention. The preferred fluoborate and/or fluosilicate may be supplied in the form of at least one salt or acid, for example, fluoboric acid, sodium fluoborate, potassium fluoborate and other alkali metal fluoborates, fluosilicic acid, sodium fluosilicate, potassium fluosilicate, and other alkali metal fluosilicates.

The concentration of the complex fluoride ion is given by the following equation:

$$0.4 \cong y \geqq 0.63x - 0.042$$

where x is the concentration of the zinc ion in weight percent and y is the concentration of the complex fluoride ion in weight percent. The preferred highest concentration of the complex fluoride ion is about 0.2% by weight regardless of the concentration of the zinc ion. The necessary amount of the complex fluoride ion increases linearly with the amount of the zinc ion. If the concentration of complex fluoride ion is less than that required by the aforementioned equation, the resulting zinc phosphate coatings do not have an improved alkali resistance; do not have excellent adhesion to paint films; and do not have excellent corrosion resistance after painting. If the concentration of complex fluoride ion is above about 0.4% by weight, regardless of the concentration of zinc ion, formation of a sufficient zinc phosphate coating fails to take place, thus yielding poor coatings with yellow rust and/or bare spots.

The nickel ions and nitrate ions are not essential to the composition of the invention. It is preferred, however, that the coating compositions contain them since they facilitate formation of zinc phosphate coatings, especially on substrates that are difficult to coat such as some types of steel.

The nickel ion may be supplied in the form of a soluble salt, for example, nickel phosphate, nickel nitrate, nickel carbonate and nickel oxide. The concentration of the nickel ion may be above about 0.005% by weight, preferably from about 0.005 to about 0.1% by weight. With concentrations below about 0.005% by weight, the nickel ion is ineffective since the forming of the resulting zinc phosphate coating is little better than that of coatings without nickel ion. Using concentrations above about 0.1% by weight, the forming of zinc phosphate coatings no longer increases, while the cost of the added nickel increases uneconomically. The nitrate ion may be supplied in the form of a soluble salt and/or acid, for example, nitric acid, sodium nitrate, potassium nitrate and other alkali metal nitrates. The concentration of the nitrate ion may be above about 0.3% by weight, preferably from about 0.3 to about 0.8% by weight. Addition of the nitrate ion at concentrations below about 0.3% by weight is ineffective, and addition at above about 0.8% by weight produces yellow rust and/or bare spots, resulting in a lower corrosion resistance after painting.

The nickel and nitrate ions may be added to the composition of the invention either alone or in combination within the limits of the aforementioned ranges, to facilitate forming of the zinc phosphate coatings.

In order to form a coating having excellent adhesion to a paint film and excellent corrosion resistance after painting, when used as an undercoat for cationic electrodeposition, it is preferred to treat a metal object, whose surfaces have been cleaned, with the composition of the invention at a temperature from about 35° to about 65° C. for a time longer than about 30 seconds. Any of the methods of application, for example, dipping, brushing, spraying, spraying-dipping and rolling may be employed to apply the composition. A preferred method of application is by spraying; preferably for about 2 minutes. The application of the coating composition is then followed by water-washing and drying according to the usual method.

The metal surface to be treated with the composition of the invention may be iron, zinc, aluminum or their alloys, preferably iron.

The coatings obtained according to the present invention have a finer crystalline structure than those obtained from the prior art, thus giving an improved adhesion to paint films. Moreover, due to the increased alkali resistance, the coatings can withstand the alkalis produced during corrosion after painting, as well as the alkalis produced in the bath during cationic electrodeposition, thereby preventing breakdown of adhesion to the paint film, and resulting in higher corrosion resistance.

The following examples are illustrative, but non-limiting embodiments of the present invention. Comparative examples are also provided.

The procedure set out below as followed in each of the five examples and in each of the five comparative examples:

PROCEDURE

A. Test Pieces Used: JIS-G-3141 SPCC SD (70×150×0.8 mm).

B. Steps Of Process: Grease removal→Water-Washing→Coating→Water-washing→Washing with deionized water→drying.

C. Process Conditions:

(1) Grease Removal: A solution of 2% by weight "RIDOLINE 75N" (a product of NIPPON PAINT) was sprayed at 60° C. for 2 minutes;

(2) Water-Washing: Tap water was sprayed at room temperature for 15 seconds;

(3) Coating: The aqueous coating compositions are given in Tables 1 and 2, below: the conditions of the bath are also given in Tables 1 and 2. The coating solution or bath was sprayed at 52° C. for 2 minutes;

(4) Wash With Deionized Water: Deionized water of 50,000 ohm-cm was sprayed at room temperature for 10 seconds;

(5) Drying: Hot air was applied at 120° C. for 10 minutes.

D. Cationic Electrodeposition: "POWER TOP U-30" (a product of NIPPON PAINT) was used under typical application conditions (e.g., at 270 volts for 3 minutes to provide a film thickness of 20 microns) and baking conditions (e.g., at 175° C. for 25 minutes).

E. Composite Paints:

Intermediate Paint: A melamine alkyd resin paint ("ORGA S-50 SEALER", a product of NIPPON PAINT) was applied at a film thickness of 30 microns under typical baking conditions (e.g., at 140° C. for 30 minutes).

Finishing Paint: A melamine alkyd resin paint ("ORGA G-26 #208 YELLOW", a product of NIPPON PAINT) was applied at a film thickness of 30 microns under typical baking conditions (e.g., at 140° C. for 30 minutes).

EXAMPLES 1 THROUGH 5

Five sets of Test Pieces as defined above were treated according to the aforementioned PROCEDURE; the only differences being that a different coating composition was applied to each set of Test Pieces and different bath conditions existed for each set. The specific coating compositions applied and the specific bath conditions are defined in Table 1.

The results of evaluation of the sets of Test Pieces thus coated and painted are summarized in Table 1

TABLE 1

| | EXAMPLES | | | | |
|---|---|---|---|---|---|
| | 1 % by wt. | 2 % by wt. | 3 % by wt. | 4 % by wt. | 5 % by wt. |
| Aqueous Coating Composition | | | | | |
| Zn ion | 0.12 | 0.12 | 0.12 | 0.17 | 0.14 |
| $PO_4$ ion | 1.50 | 1.50 | 1.00 | 1.80 | 1.50 |
| $ClO_3$ ion | 0.20 | 0.20 | 0.10 | 0.28 | 0.20 |
| $NO_2$ ion | 0.01 | 0.01 | 0.02 | 0.01 | 0.03 |
| $BF_4$ ion | 0.04 | — | 0.03 | 0.10 | 0.15 |
| $SiF_6$ ion | — | 0.04 | 0.03 | — | — |
| F ion | — | — | — | — | — |
| Ni ion | — | — | — | 0.05 | — |
| $NO_3$ ion | — | — | 0.50 | 0.30 | 0.50 |
| Conditions of Bath | point | point | point | point | point |
| F.A. | 0.9 | 0.8 | 0.8 | 1.0 | 0.8 |
| T.A. | 18 | 18 | 16 | 23 | 19 |
| Items of Evaluation | | | | | |
| Appearance | even | even | even | even | even |
| Crystal size | fine | fine | fine | fine | fine |
| Coating weight | 1.5 g/m² | 1.6 g/m² | 1.3 g/m² | 1.8 g/m² | 1.3 g/m² |
| Alkali resistance | 5.0% | 4.5% | 4.5% | 8.5% 7.0% | |
| Adhesion | 100/100 | 100/100 | 100/100 | 95/100 | 100/100 |
| Corrosion resist. | ≦1.0 mm | ≦1.0 mm | ≦1.0 mm | ≦1.0 mm | ≦1.0 mm |

COMPARATIVE EXAMPLES 1 THROUGH 5

Five sets of Test Pieces as defined above were treated according to the aforementioned PROCEDURE; the only differences being that a different coating composition was applied to each set of Test Pieces and different bath conditions existed for each set. The specific coating compositions applied and the specific bath conditions are defined in Table 2.

The results of evaluation of the sets of Test Pieces thus coated and painted are summarized in Table 2.

DEFINITIONS OF TERMS USED IN TABLES 1 AND 2:

1. "F.A." denotes the amount in ml of 0.1 N—NaOH required to neutralize a 10 ml sample of the treating bath using a bromphenol blue indicator.

2. "T.A." denotes the amount in ml of 0.1 N—NaOH required to neutralize a 10 ml sample of the treating bath using a phenolphthalene indicator.

3. "Alkali Resistance" denotes the loss in % by weight of the coating when the coated Test Piece was immersed in an aqueous solution of ammonium chloride, (5.35 g/l of $NH_4Cl$), adjusted to pH 10.0 by addition of ammonia water, at 30° C. for 5 minutes.

$$\text{"Alkali Resistance"} = \frac{\text{the coating weight dissolved}}{\text{the total coating weight}} \times 100\%$$

4. "Adhesion" denotes that the painted Test Piece was immersed in tap water at 50° C. for 10 days and then the water was wiped off.

TABLE 2

| | COMPARATIVE EXAMPLES | | | | |
|---|---|---|---|---|---|
| | 1 % by wt. | 2 % by wt. | 3 % by wt. | 4 % by wt. | 5 % by wt. |
| Aqueous Coating Composition | | | | | |
| Zn ion | 0.12 | 0.17 | 0.06 | 0.15 | 0.12 |
| $PO_4$ ion | 1.50 | 1.80 | 1.50 | 1.00 | 1.50 |
| $ClO_3$ ion | 0.10 | 0.20 | 0.15 | 0.10 | 0.20 |
| $NO_2$ ion | 0.01 | 0.01 | 0.01 | 0.01 | 0.01 |
| $BF_4$ ion | — | 0.04 | — | 0.45 | — |
| $SiF_6$ ion | — | — | — | — | — |
| F ion | — | — | — | — | 0.04 |
| Ni ion | 0.03 | 0.05 | 0.05 | 0.03 | 0.05 |
| $NO_3$ ion | 0.30 | 0.50 | 0.50 | 0.30 | 0.30 |
| Conditions of Bath | point | point | point | point | point |
| F.A. | 0.9 | 1.0 | 0.8 | 0.8 | 0.9 |
| T.A. | 18 | 22 | 17 | 15 | 17 |
| Items of Evaluation | | | | | |
| Appearance | even | even | yellow rust uneven | yellow rust uneven | even |
| Crystal size | a little coarse | coarse | fine | fine | a little coarse |
| Coating weight | 1.8 g/m² | 2.8 g/m² | 1.0 g/m² | 1.0 g/m² | 1.5 g/m² |
| Alkali resistance | 19.6% | 35.3% | 6.9% | 26.4% | 21.9% |
| Adhesion | 0/100 | 0/100 | 90/100 | 70/100 | 20/100 |
| Corrosion resist. | 5 mm | 4 mm | 6 mm | 5 mm | 4 mm |

The paint surface was then cut into 100 squares of 2 mm by 2 mm with a razor to a depth reaching the surface of the substrate. An adhesive tape was then pressed to the surface and peeled off. Adhesion was measured by the number of squares of the paint film remaining on the surface of the substrate.

5. "Corrosion Resistance" denotes that an "X" was cut into the surface of the electrodeposited paint film on the Test Piece with a razor to a depth reaching the surface of the substrate. This painted Test Piece was then subjected to a salt-water spraying test according to JIS-Z-2371 for 1500 hours. As soon as the salt water was wiped off, an adhesive tape was pressed along the cut line and then peeled off. The corrosion resistance was measured in terms of the maximum width, from the cut line, of removal of the paint film.

It is apparent from the results summarized in Table 1, that the zinc phosphate coatings formed by application of the coating composition of the present invention have an even appearance, excellent adhesion to paint films, and excellent corrosion resistance after painting.

We claim:

1. An acidic, aqueous coating solution for forming a zinc phosphate coating on a metal surface comprising about 0.08 to about 0.2 weight percent of zinc ion, about 0.8 to about 3 weight percent of phosphate ion, about 0.05 to about 0.35 weight percent of chlorate ion, about 0.001 to about 0.1 weight percent of nitrite ion, and a complex fluoride ion having the following concentration:

$$0.4 \geqq y \geqq 0.63x - 0.042$$

wherein x is the concentration of the zinc ion in weight percent and y is the concentration of the complex fluoride ion in weight percent.

2. The coating solution of claim 1 wherein the concentration of phosphate is from about 0.8 to about 2 weight percent, and the concentration of complex fluoride ion is about 0.2 weight percent.

3. The coating solution of claim 1 wherein the zinc ion is supplied in the form of a soluble zinc containing compound selected from the group consisting of zinc phosphate, zinc nitrate, zinc carbonate, zinc hydroxide, zinc oxide and zinc metal.

4. The coating solution of claim 1 wherein the phosphate ion is supplied in the form of a compound selected from the group consisting of phosphoric acid, alakli metal phosphates, nickel phosphate, zinc phosphate and mixtures thereof.

5. The coating solution of claim 1 wherein the chlorate ion is supplied in the form of a compound selected from the group consisting of chloric acid, alkali metal chlorates, and mixtures thereof.

6. The coating solution of claim 1 wherein the nitrite ion is supplied in the form of a compound selected from the group consisting of nitrous acid, alkali metal nitrites, and mixtures thereof.

7. The coating solution of claim 1 wherein the complex fluoride ion is selected from the group consisting of fluoborate, fluosilicate, and mixtures thereof.

8. The coating solution of claim 7 wherein the fluoborate is supplied in the form of a compound selected from the group consisting of fluoboric acid, alkali metal fluoborates, and mixtures thereof.

9. The coating solution of claim 7 wherein the fluosilicate is supplied in the form of a compound selected from the group consisting of fluosilicic acid, alkali metal fluosilicates, and mixtures thereof.

10. The coating solution of claim 1 including at least about 0.005 weight percent of nickel ion.

11. The coating solution of claim 10 wherein the concentration of the nickel ion is about 0.005 to about 0.1 weight percent.

12. The coating solution of claim 10 wherein the nickel ion is supplied in the form of a soluble salt selected from the group consisting of nickel phosphate, nickel nitrate, nickel carbonate and nickel oxide.

13. The coating solution of claim 1 including about 0.3 to about 0.8 weight percent of nitrate ion.

14. The coating solution of claim 13 wherein the nitrate ion is supplied in the form of a compound selected from the group consisting of nitric acid, alkali metal nitrates, and mixtures thereof.

15. An acidic aqueous coating composition for forming a zinc phosphate coating on a metal surface comprising about 0.08 to about 0.2 weight percent of zinc ion, about 0.8 to about 2 weight percent of phosphate ion, about 0.05 to about 0.35 weight percent of chlorate ion, about 0.001 to about 0.1 weight percent of nitrite ion, about 0.005 to about 0.1 weight percent of nickel ion, about 0.3 to about 0.8 weight percent of nitrate ion, and a complex fluoride ion selected from the group consisting of fluoborate, fluosilicate, and mixtures thereof, having the following concentration:

$$0.4 \geqq y \geqq 0.63x - 0.042$$

where x is the concentration of the zinc ion in weight percent and y is the concentration of the complex fluoride ion in weight percent.

16. A process for forming a zinc phosphate coating on a metal surface comprising contacting the metal surface with an acidic aqueous coating composition comprising about 0.08 to about 0.2 weight percent of zinc ion, about 0.8 to about 3 weight percent of phosphate ion, about 0.05 to about 0.35 weight percent of chlorate ion, about 0.001 to about 0.1 weight percent of nitrite ion, and a complex fluoride ion having the following concentration:

$$0.4 \geqq y \geqq 0.63x - 0.042$$

wherein x is the concentration of the zinc ion in weight percent and y is the concentration of the complex fluoride ion in weight percent.

17. The process of claim 16 wherein the coating composition is sprayed on the surface.

18. The process of claim 17 wherein the metal surface is sprayed for longer than about 30 seconds.

19. The process of claim 18 wherein the metal surface is sprayed for about 2 minutes.

20. The process of claim 16 wherein the temperature of the coating composition is about 35° to about 65° C.

21. The process of claim 17, 18, 19 or 20 including applying to said zinc phosphate coating a paint film by cationic electrodeposition.

22. A metal surface having thereon a zinc phosphate coating formed by the process of claim 16.

23. A process for coating a metal surface comprising: (A) forming on the metal surface a zinc phosphate coating by contacting the metal surface with an acidic, aqueous coating solution consisting essentially of about 0.08 to about 0.2 weight percent of zinc ion, about 0.8 to about 3 weight percent of phosphate ion, about 0.05 to about 0.35 weight percent of chlorate ion, about 0.001 to about 0.1 weight percent of nitrite ion, and a complex fluoride ion having the following concentration:

$$0.4 \geqq y \geqq 0.63x - 0.042$$

wherein x is the concentration of the zinc ion in weight percent and y is the concentration of the complex fluoride ion in weight percent; and (B) forming on the coated surface a paint film by cationic electrodeposition.

24. A process according to claim 23 wherein the coating solution is as defined in claim 2, 3, 4, 5, 6, 7, 8, 9, 10, 11, 12, 13, 14 or 15.

* * * * *